US006415704B1

(12) United States Patent
Wang

(10) Patent No.: US 6,415,704 B1
(45) Date of Patent: Jul. 9, 2002

(54) PNEUMATIC OIL PUMP

(76) Inventor: Ta-Chin Wang, No. 10, Hsin-Jen Rd., Tainan (TW)

( * ) Notice: Subject to any disclaimer, the term of this patent is extended or adjusted under 35 U.S.C. 154(b) by 0 days.

(21) Appl. No.: 09/755,677

(22) Filed: Jan. 4, 2001

(51) Int. Cl.[7] ..... F04B 35/02
(52) U.S. Cl. ..... 91/224; 417/401; 91/321
(58) Field of Search ..... 60/481; 91/224, 91/321, 399; 417/401, 903; 181/230, 258

(56) References Cited

U.S. PATENT DOCUMENTS 3,788,781 A * 1/1974 McClocklin ..... 417/401
6,012,377 A * 1/2000 Hung ..... 91/224

* cited by examiner

*Primary Examiner*—Edward K. Look
*Assistant Examiner*—Thomas E. Lazo
(74) *Attorney, Agent, or Firm*—Kolisch Hartwell Dickinson McCormack & Heuser

(57) ABSTRACT

A pneumatic oil pump has a cylinder, a piston, a pedal and an oil reservoir. The cylinder has a central bore, a sealed front end and a sealed rear end. An air connector is mounted in a cover on the front end of the cylinder. An actuating valve is mounted in the cover on the front end of the cylinder and communicating with the air connector and the central bore of the cylinder. The piston is movably mounted in the bore of the cylinder to divide the central bore of the cylinder into a first chamber and a second chamber. A piston seat is attached to the piston at an end facing the rear end of the cylinder. A ventilative, sound-absorbing material is arranged between the air outlets of the piston and the piston seat. By such an arrangement, the shock of the air flow can be absorbed by the ventilative, sound absorbing material. Therefore, noise and shock will not occur when the pneumatic pump is in operation.

14 Claims, 9 Drawing Sheets

PNEUMATIC OIL PUMP

BACKGROUND OF THE INVENTION

1. Field of the Invention

The present invention relates to a pneumatic oil pump, and more particularly to a pneumatic oil pump for a hydraulic device.

2. Description of Related Art

With reference to FIGS. 8 and 9, a conventional pneumatic motor to drive a hydraulic pump in accordance with the prior art comprises a cylinder (80), a piston (84), a drive rod (86), a spring (88) and a rod base (83). A front cover (81) and a rear cover (82) are respectively used to cover each end of the cylinder (80). An inlet (812) is defined in the front cover (81) to connect to a high-pressure air supply. An outlet (822) is defined in the rear cover (82) to release the air. A recess (802) is defined in the inner surface of the cylinder (80) near the middle position of the cylinder (80).

The piston (84) is movably received in the cylinder (80) so as to divide the cylinder (80) into a first chamber communicating with the inlet (812) and a second chamber communicating with the outlet (822). A seal (841) is mounted around the piston (84) at each end of the piston (84). An inlet passage (842) is defined in the piston (84) between the seals (841). A cavity (844) is defined in the piston (84) and communicates with the inlet passage (842). An outlet passage (846) is defined in the piston (84) and communicates with both chambers of the cylinder (80). An inner piston (90) is movably received in the cavity (844) of the piston (84). A rod (92) is secured to the inner piston (90) and extends into the first chamber of the cylinder (80). A valve disk (94) is secured to the rod (92) to close the passage between the outlet passage (846) and first chamber of the cylinder (80).

The drive rod (86) is attached to the piston (84) and extends into a passage (832) defined in the rod base (83). The spring (88) is mounted between the piston (84) and the rear cover (82) to provide a pushing force to the piston (84), such that the piston (84) abuts the front cover (81) before the pump is in operation. The rod base (33) is connected to an oil reservoir.

In operation, high-pressure air is injected into the first chamber through the inlet (812). The piston (84) is pushed relative to the cylinder (80) by the air pressure. The drive rod (86) moves inward relative to the passage (832), and the spring (88) is compressed. When the piston (84) moves to the position where the seal (841) on the inlet end of the piston (84) is in the recess (802), the air in the first chamber will flow into the cavity (844) in the piston (84) through the recess (802) and the inlet passage (842). The air will move the inner piston (90) relative to the cavity (844), and the valve disk (94) opens to allow the first chamber to communicate with the outlet passage (846). Accordingly, the air in the first chamber will directly flow into the second chamber through the outlet passage (846). The pushing force provided by the air pressure on the piston (84) will reduce. The tension in the compressed spring (88) will move the piston (84) back toward the front cover (81), and the drive rod (86) moves outward relative to the passage (832) in the rod base (83). When the valve disk (94) strikes the front cover (81), the valve disk (94) is pushed toward the piston (84) and closes the passage between the first chamber and the outlet passage (846). Consequently, the high-pressure air pushes the piston (84) toward the rear cover (82) again. Accordingly, a suction force will be applied to the oil in the oil reservoir as the drive rod (86) moves backward and pressure will be applied to the oil in the passage (832) as the drive rod moves forward. With the appropriate use of a series of valves, the oil can be transmitted to a hydraulic device like a power repairing kit, a hoisting jack, a hydraulic cylinder, a hydraulic jack or the like.

However, the conventional pneumatic motor for a hydraulic pump has the following disadvantages:

1. Noise and shock easily occur when the high-pressure air is released through the outlet passage (846).
2. Noise occurs when the valve disk (94) strikes the front cover (81).
3. Dust easily enters the cylinder (80) through the outlet (822), such that the inner elements of the pneumatic motor are easily worn out. The useful life of the pneumatic motor is shortened.

To overcome the shortcomings, the present invention tends to provide an improved pneumatic motor for a hydraulic pump to mitigate or obviate the aforementioned problems.

SUMMARY OF THE INVENTION

The main objective of the invention is to provide an improved pneumatic oil pump that can reduce the noise generated by the pneumatic motor. The pneumatic oil pump comprises a cylinder, a piston, a pedal and an oil reservoir. The cylinder has a central bore, a sealed front end and a sealed rear end. An air connector is mounted on the front end of the cylinder. An actuating valve is mounted on the front end of the cylinder and communicates with the air connector and the central bore of the cylinder. The piston is movably mounted in the bore to divide the central bore into a first chamber and a second chamber. A piston seat is attached to the piston on the end facing the rear end of the cylinder. A ventilative, sound-absorbing material is mounted between the air outlets of the piston and the piston seat. With such a ventilative, sound absorbing material, noise will not occur when the air releases from the cylinder.

The secondary objective of the invention is to provide an improved pneumatic oil pump wherein an exhaust valve is mounted on the cylinder and communicates with the second chamber in the cylinder. Consequently, dust cannot enter the cylinder. Wear of the inner elements can be significantly reduced, and the useful life of the pneumatic oil pump is prolonged.

The third objective of the invention is to provide an improved pneumatic oil pump wherein a pushing rod is slidably mounted on the front end of the cylinder and communicates with the air connector. With such a pushing rod, the impact between the piston and the front end of the cylinder can be cushioned. Noise will not occur when the air pump is in operation.

Other objects, advantages and novel features of the invention will become more apparent from the following detailed description when taken in conjunction with the accompanying drawings.

DETAILED DESCRIPTION OF PREFERRED EMBODIMENT

Figure 1:
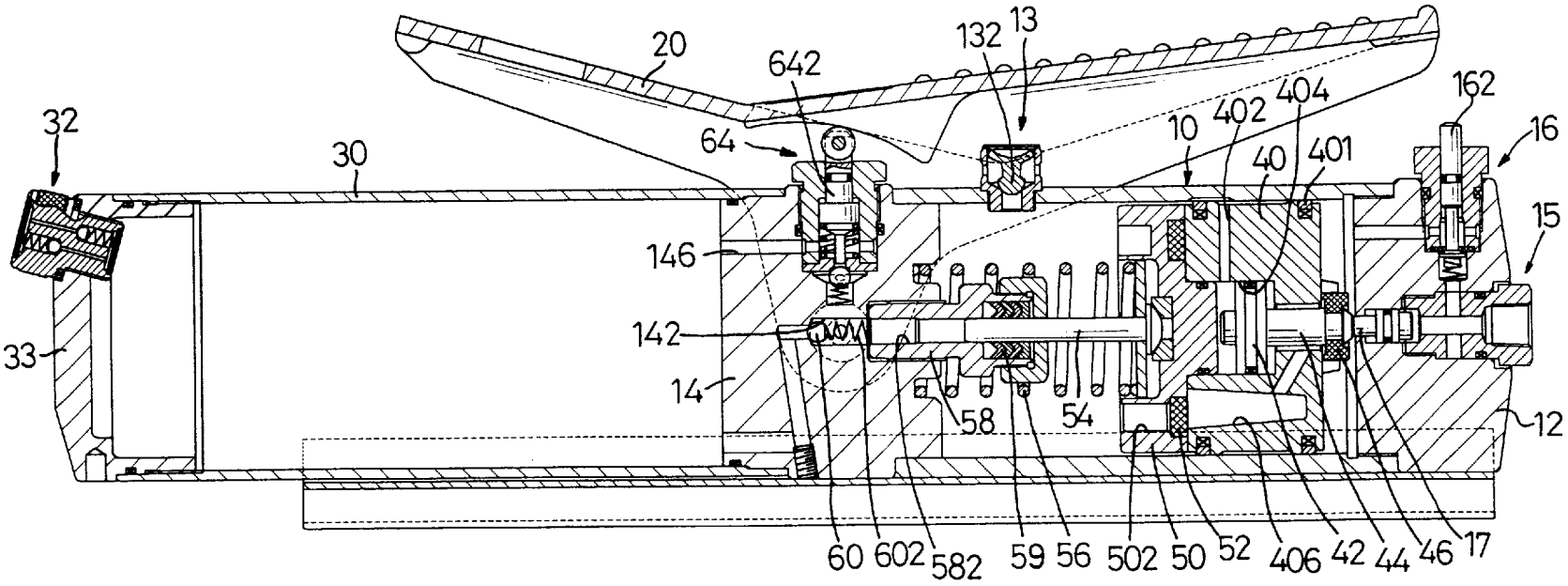
FIG. 1 is a cross sectional side plan view of a pneumatic oil pump in accordance with the present invention.

With reference to FIG. 1, a pneumatic oil pump in accordance with the present invention comprises a cylinder (10), a piston (40), a pedal (20) and an oil reservoir (30). The cylinder (10) is hollow and has a sealed front end and a sealed rear end. The front end of the cylinder (10) is covered with a front cover (12) is mounted in the front end of the cylinder (10), and a rear cover (14) is mounted in the rear end of the cylinder (10) between the cylinder (10) and the oil reservoir (30). An air connector (15) is mounted in the front cover (12) of the cylinder (10) and connects to a high-pressure air supply. An actuating valve (16) is mounted in the front cover (12) of the cylinder (10) in line between the air connector (15) and the inside of the cylinder (10). A stem (162) movably extends out from the actuating valve (16). A recess (102) is defined in the inner surface of the cylinder (10) near the middle of the cylinder (10).

The piston (40) is movably received in the cylinder (10), such that the inside of the cylinder (10) is divided into a first chamber communicating with the actuating valve (16) and a second chamber between the piston (40) and the rear cover (14). A seal (401) is mounted around the piston (40) at each end of the piston (40). A central cavity (404) is defined in the piston (40). An inlet passage (402) is defined in the piston (40) between the seals (401) from the outside edge of the piston (40) to the central cavity (404). An outlet passage (406) is defined in the piston (40) and communicates with both chambers of the cylinder (10). An inner piston (42) is movably mounted in the cavity (404) of the piston (40). A rod (44) is secured to the inner piston (42) and extends into the first chamber of the cylinder (10). A valve disk (46) is attached to the rod (44) to selectively close the opening between the outlet passage (406) and first chamber of the cylinder (10). A pushing rod (17) is slidably mounted an axial cavity in the front cover (12) corresponding to and communicating with the air connector (15). The pushing rod (17) aligns with the valve disk (46) and causes the valve disk (46) to close the outlet passage (406) when the piston (40) approaches the front cover (12).

A piston seat (50) is attached to the end of the piston (40) facing the rear cover (14) of the cylinder (10). An outlet passage (502) is defined in the piston seat (50) and aligns with the outlet passage (406) in the piston (40). A ventilative, sound-absorbing material (52) is arranged between the air outlets (406, 502) in the piston (40) and the piston seat (50).

A drive rod (54) is attached to the piston seat (50) and extends toward the rear cover (14). A piston spring (56) is mounted around the drive rod (54) between the rear cover (14) and the piston seat (50) to provide a restoration force to the piston seat (50) and the piston (40).

An exhaust valve (13) is mounted on the cylinder (10) and communicates with the second chamber of the cylinder (10). A disk (132) made of resilient material like rubber or silicon is mounted in the exhaust valve (13) to close the passage between the cylinder (10) and the exhaust valve (13).

The pedal (20) is pivotally mounted on the cylinder (10). One end of the pedal (20) aligns with the stem (162) of the actuating valve (16).

One end of the oil reservoir (30) is secured to the cylinder (10) and sealed by the rear cover (14). The other end of the oil reservoir (30) is closed and sealed with an end cap (33). A combination vacuum breaker and air pressure relief valve (32) is mounted in the end cap (33) to allow air to flow into or out of the oil reservoir (30).

A series of passages and one-way valves in the rear cover (14) in conjunction with the drive rod (54) is used to implement the oil pump. An oil channel (142) is defined in the rear cover (14) to communicate with the oil reservoir (30). A first ball (60) and spring (602) combination is movably received in the oil channel (142) to close the passage between the oil channel (142) and the oil reservoir (30). A rod base (58) is attached to the cylinder (10) side of the rear cover (14). The end of the drive rod (54) not attached to the piston seat (50) is slidably mounted in a passage (582) defined in the rod base (58). The passage (582) is aligned and communicates with the oil channel (142). Multiple gaskets (59) are mounted in the rod base (58) around the drive rod (54). The gaskets (59) provide a seal between the drive rod (54) and the rod base (58).

Figure 4:
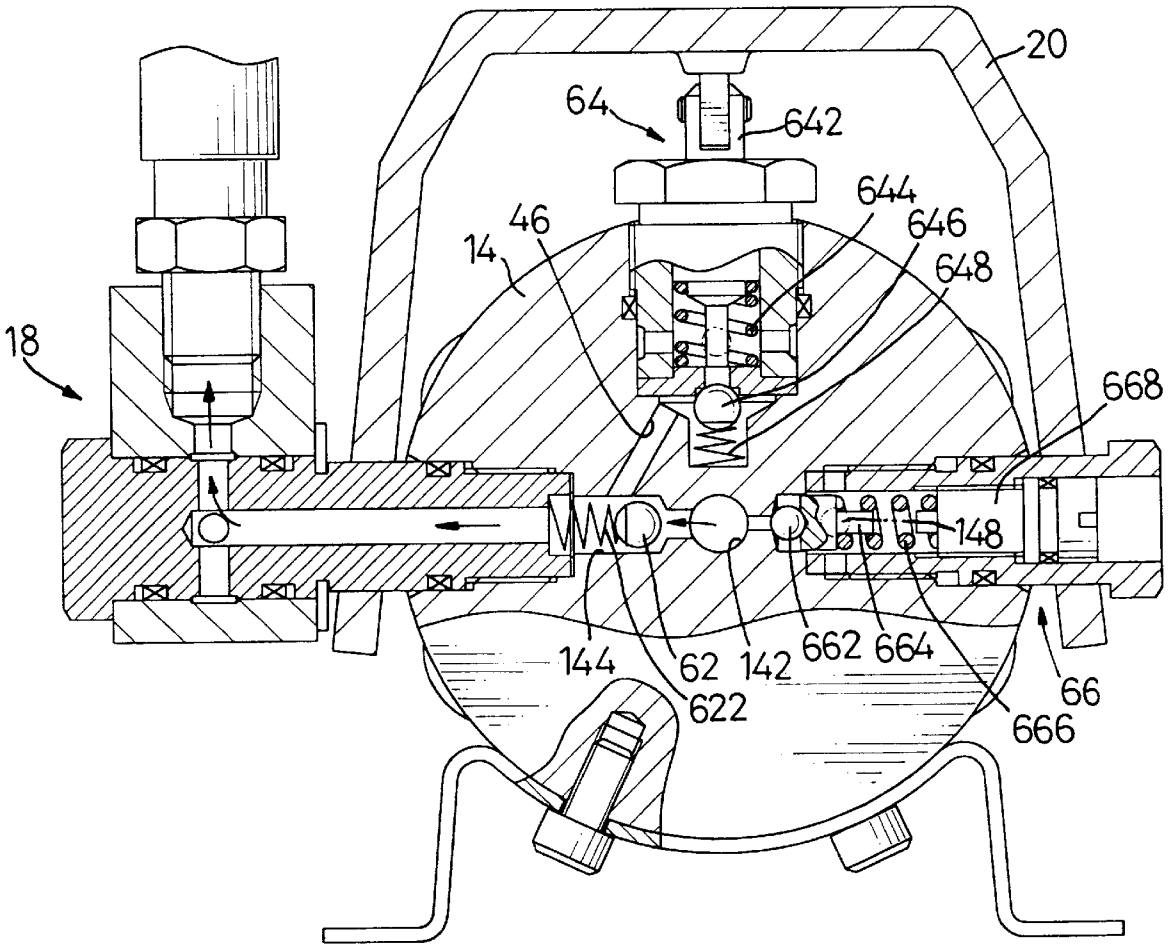
FIG. 4 is an operational front plan view in partial section of the pneumatic oil pump in FIG. 1 showing the oil being discharged through the outlet connector by the cylinder.

With reference to FIGS. 1 and 4, an oil discharge passage (144) is defined in the rear cover (14) and communicates with the oil channel (142). An oil discharge connector (18) connected to a hydraulic device is mounted on the cylinder (10) and communicates with the oil discharge passage (144). A second ball (62) and spring (622) combination is movably received in the oil discharge passage (144) to close the passage between the oil channel (142) and oil discharge passage (144) to prevent return flow.

Figure 2:
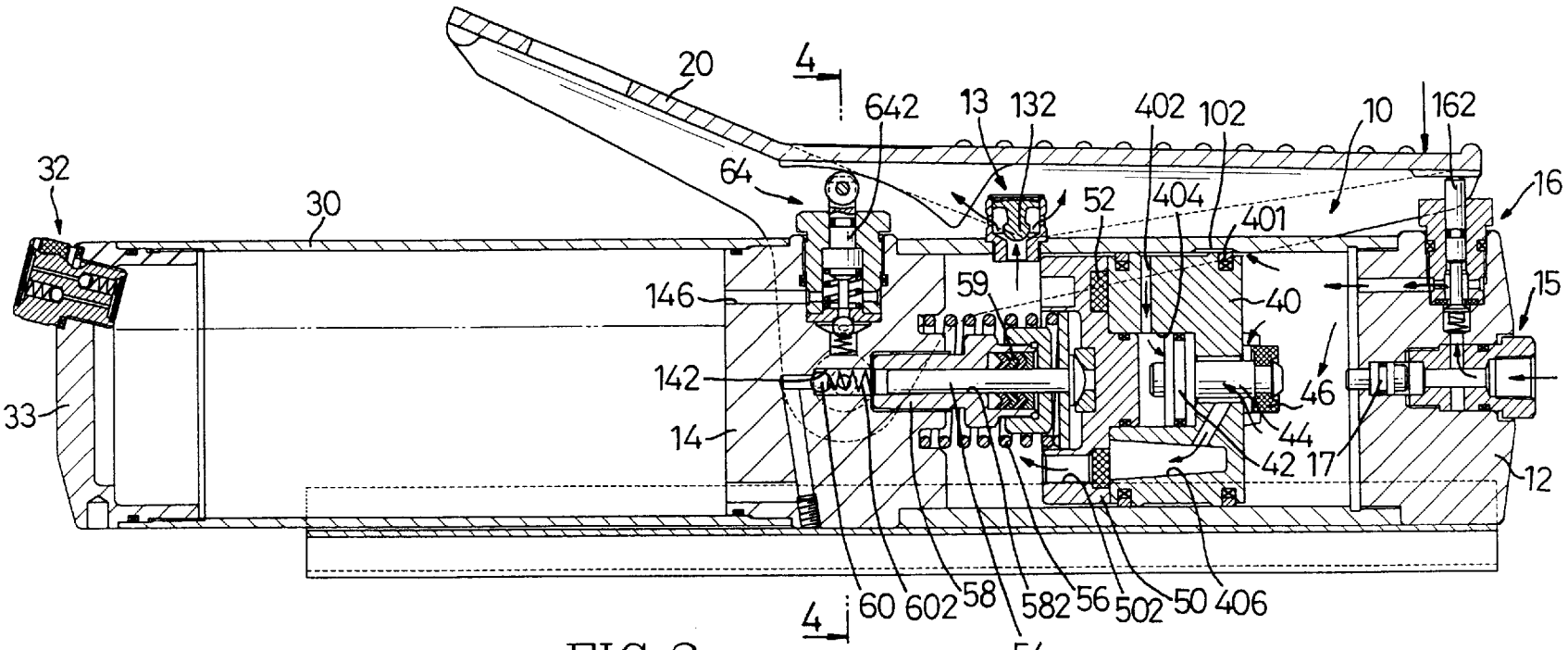
FIG. 2 is an operational cross sectional side plan view of the pneumatic oil pump in FIG. 1 showing the air being supplied to the cylinder to operate the pneumatic motor when the pedal is pressed.
Figure 3:
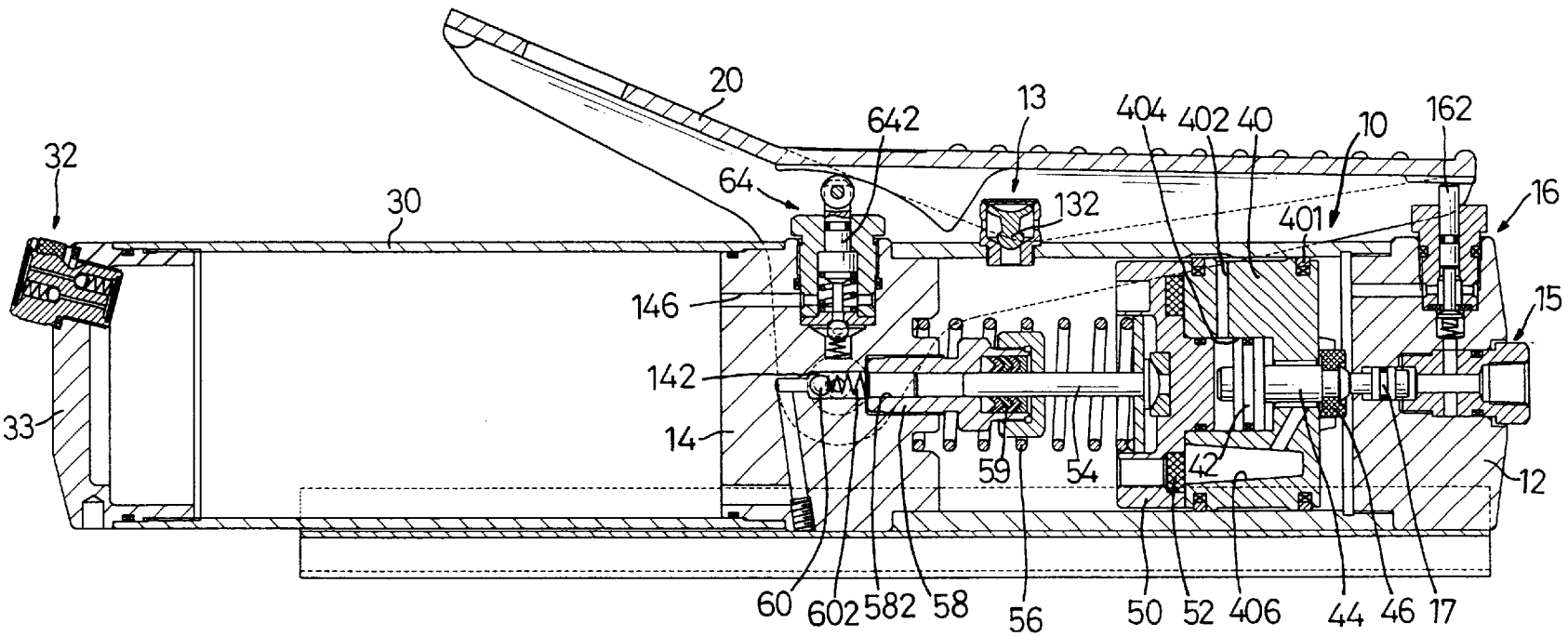
FIG. 3 is an operational cross sectional side plan view of the pneumatic oil pump in FIG. 1 showing the piston being pushed by the tension of the spring to move the piston backward.

With reference to FIGS. 2 to 4, when the user presses the pedal (20) forward, the end of the pedal (20) will push the stem (162) of the actuating valve (16) and the actuating valve (16) is opened. The high-pressure air flows into the first chamber of the cylinder (10) through the air connector (15) and the actuating valve (16). The high-pressure air then pushes the piston (40) with the piston seat (50) relative to the cylinder (10). The drive rod (54) moves inward relative to the passage (582) in the rod base (58). When the piston (40) moves to a position where the seal (401) is received in the recess (102), air will flow into the recess (102), the inlet passage (402) and the cavity (404) in the piston (40). The air pushes the inner piston (42) with the valve disk (46) relative to the piston (40), such that the passage between the first chamber of the cylinder (10) and the outlet passage (406) will be opened. Accordingly, the air will flow into the outlet passage (406) but not into the inlet passage (402) because the pressure at the outlet passage (406) is less than that at the inner passage (402). The air will flow into the second chamber of the cylinder (10) and released from the exhaust valve (13) by means of pushing the resilient disk (132) off the seat. The pushing force provided by the high-pressure air on the piston (40) will drop, and the piston (40) will be pushed back by the force of the compressed piston spring (56).

As the piston (40) moves back toward the front cover (12), the drive rod (54) moves out of the passage (582) in the rod base (58) and generates a suction force in the oil passages. The suction force causes the first ball (60) and spring (602) combination to move in the oil channel (142), such that the passage between the oil channel (142) and the oil reservoir (30) is opened. The oil in the oil reservoir (30) will be drawn into the oil channel (142).

When the piston (40) moves back toward the front cover (12), the valve disk (46) will strike the pushing rod (17), which will cause the valve disk (46) to close the passage between the first chamber and the air outlet passage (406). The high-pressure air pushes the piston (40) to move toward the rear cover (14). The drive rod (54) moves inward relative to the passage (582) of the rod base (58) again. This can provide a pressure to the oil contained in the oil channel (142), and the second ball (62) will be pushed to move relative to the oil discharge passage (144) by the oil pressure. Accordingly, the oil will pass through the oil discharge passage (144) and be supplied to the hydraulic device through the oil discharge connector (18). By such means, the oil contained in the oil reservoir (30) can be inhaled to the oil channel (142) and transported to the hydraulic device through the oil discharge connector (18).

When the air releases from the exhaust valve (13), there is a ventilative, sound absorbing material (52), mounted between the outlet passages (406, 502) of the piston (40) and piston seat (50), so the shock of the air flow can be absorbed. Noise does not easily occur when the high-pressure air is released. In addition, because an exhaust valve (13) is mounted on the cylinder (10), the dust cannot enter the cylinder (10). The wear of the inner elements can be avoided, and the useful life of the pneumatic motor is prolonged. Furthermore, because the pushing rod (17) communicates with the air connector (15), the air pressure also applies to the pushing rod (17). This can provide a damping effect to the pushing rod (17) like an air cushion when the valve disk (46) strikes the pushing rod (17). The air in the first chamber also provides a damping effect to the piston (40). The shock between the pushing rod (17) and the valve disk (46) can be absorbed. Shock or noise will be reduced when the pneumatic motor is in operation.

With reference to FIGS. 1 and 4, a return valve (64) is mounted in the rear cover (14) in a return passage (146) defined in the rear cover (14) to communicate with the oil reservoir (30) and the oil discharge passage (144). A stem (642) movably extends out from the return valve (64) and the rear cover (14) and abuts the pedal (20). A stem spring (644) is mounted in the return valve (64) to support the stem (642). A third ball (646) and spring (648) combination is movably mounted in the return passage (146) and aligns with the stem (642) in the return valve (64) to keep the passage between the oil discharge passage (144) and the return passage (146) normally closed.

Figure 5:
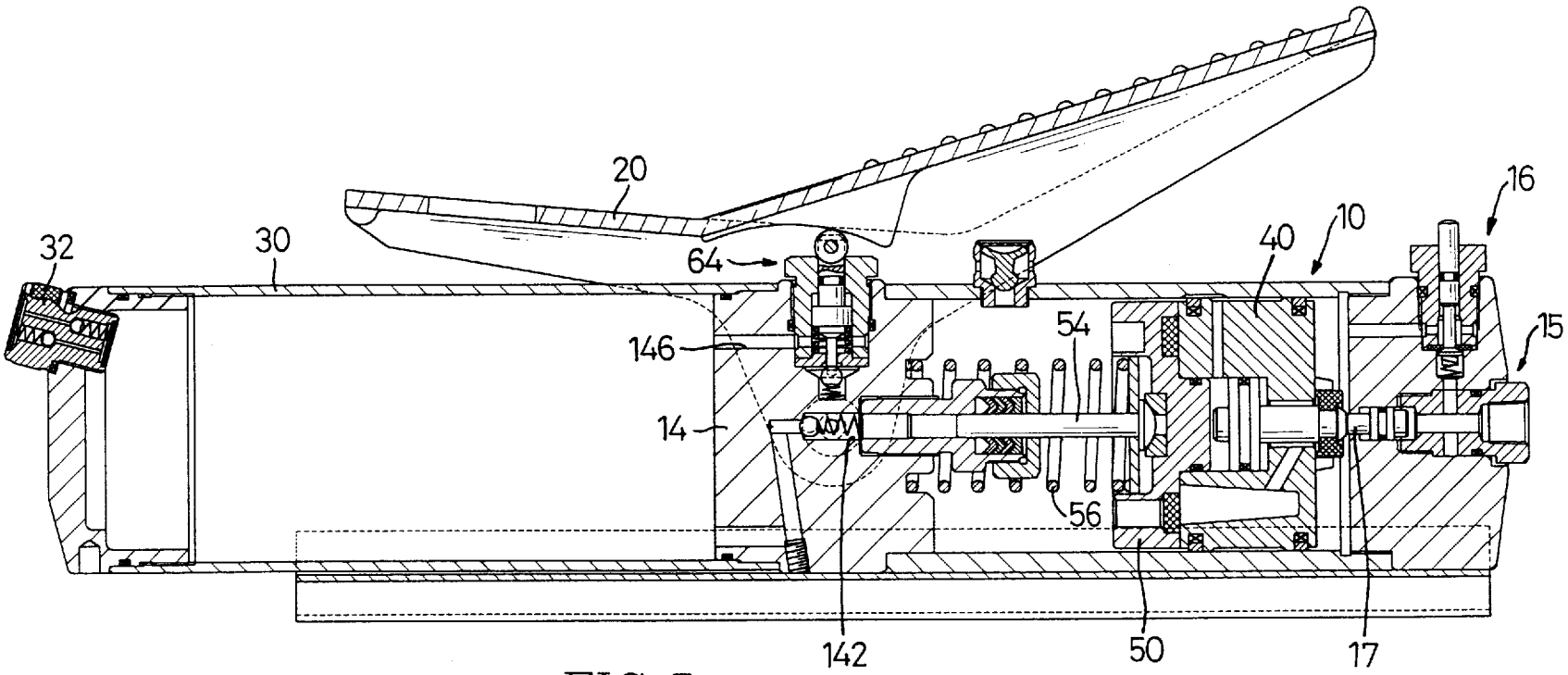
FIG. 5 is an operational cross sectional side plan view of the pneumatic oil pump in FIG. 1 showing the return valve open.
Figure 6:
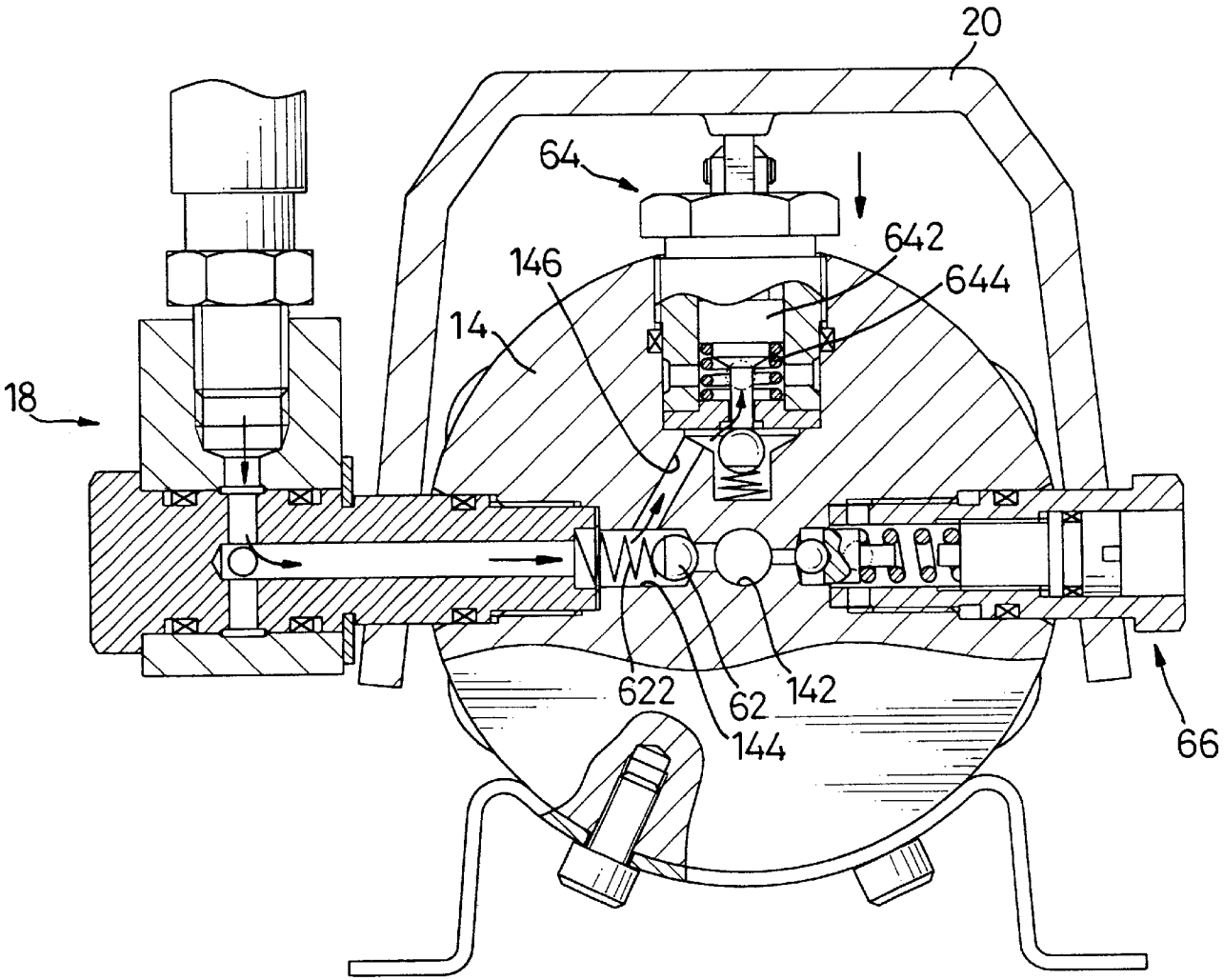
FIG. 6 is an operational side plan view in partial section of the pneumatic oil pump in FIG. 1 showing oil flowing to the oil reservoir when the return valve is open.

With reference to FIGS. 5 and 6, the user presses the pedal (20) backward to release the hydraulic pressure supplied to the connected hydraulic device. Because of the pivotal configuration of the pedal (20), the pressure applied to the stem (162) of the actuating valve (16) is released, and the actuating valve (16) closes, and the high-pressure air supply to the cylinder (10) is cutoff. The stem (642) in the return valve (64) is pressed down by the pedal (20) to push the third ball (646) out of the closed position. Accordingly, the passage between the oil discharge passage (144) and the return passage (146) is opened. The oil supplied to the hydraulic device will flow back to the oil reservoir (30) through the oil discharge connector (18), the oil discharge passage (144) and the return passage (146). When the pedal (20) is pressed forward again, the stem (642) and the third ball (646) will move to the closed position by means of the restoration force of the springs (644, 648).

With reference to FIG. 4, an overflow passage (148) is defined in the rear cover (14) between the oil channel (142) and the oil reservoir (30). An adjusting valve (66) is mounted in the overflow passage (148). The adjusting valve (66) includes a fourth ball (662) and spring (666) combination, a pushing rod (664) and a bolt (668). The fourth ball (662) normally closes the passage between the oil channel (142) and the overflow passage (148). The pushing rod (664) abuts the fourth ball (662). The bolt (668) abuts the fourth spring (666). When the oil pressure is large enough to overcome the tension of the fourth spring (666), the fourth ball (662) will be moved by the oil pressure. The oil will flow directly back to the oil reservoir (30) through the overflow passage (148) but not into the oil discharge passage (144). This can provide a control effect to the oil pressure. In addition, the tension of the fourth spring (666) can be adjusted by means of rotating the bolt (668).

Figure 7:
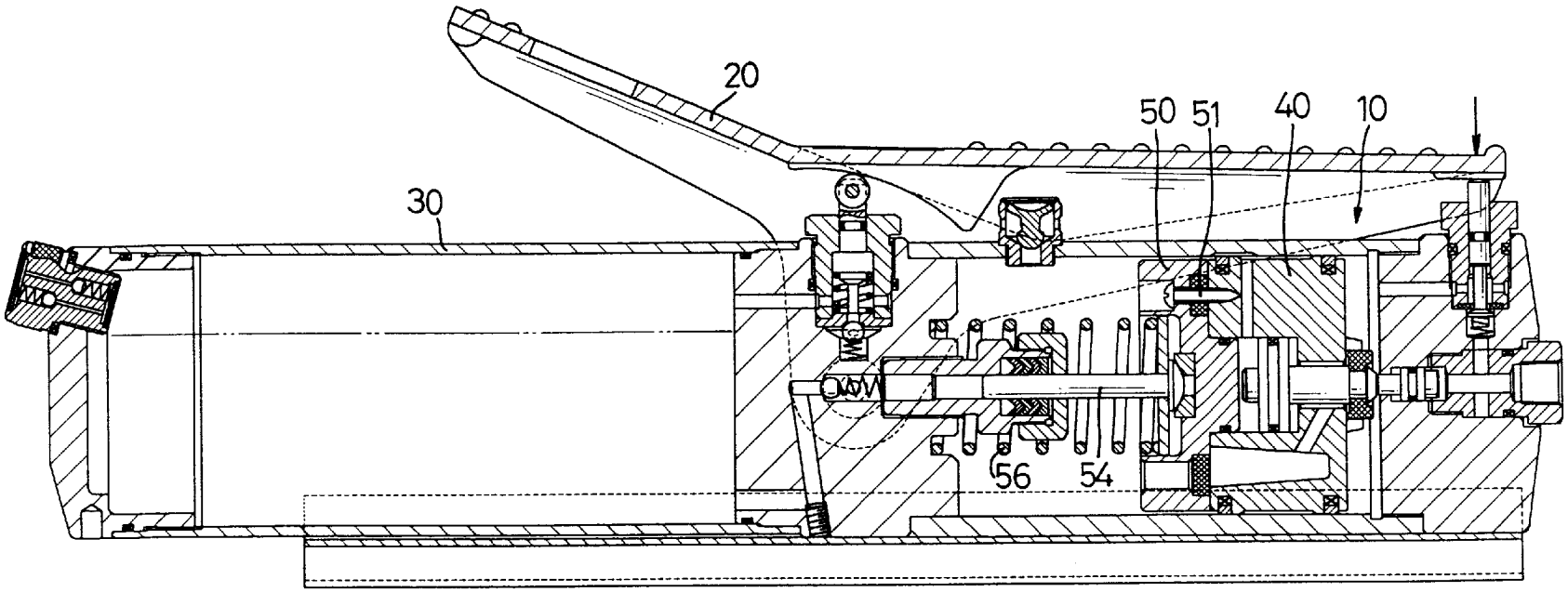
FIG. 7 is a cross sectional side plan view of another embodiment of a pneumatic oil pump in accordance with the present invention.
Figure 8:
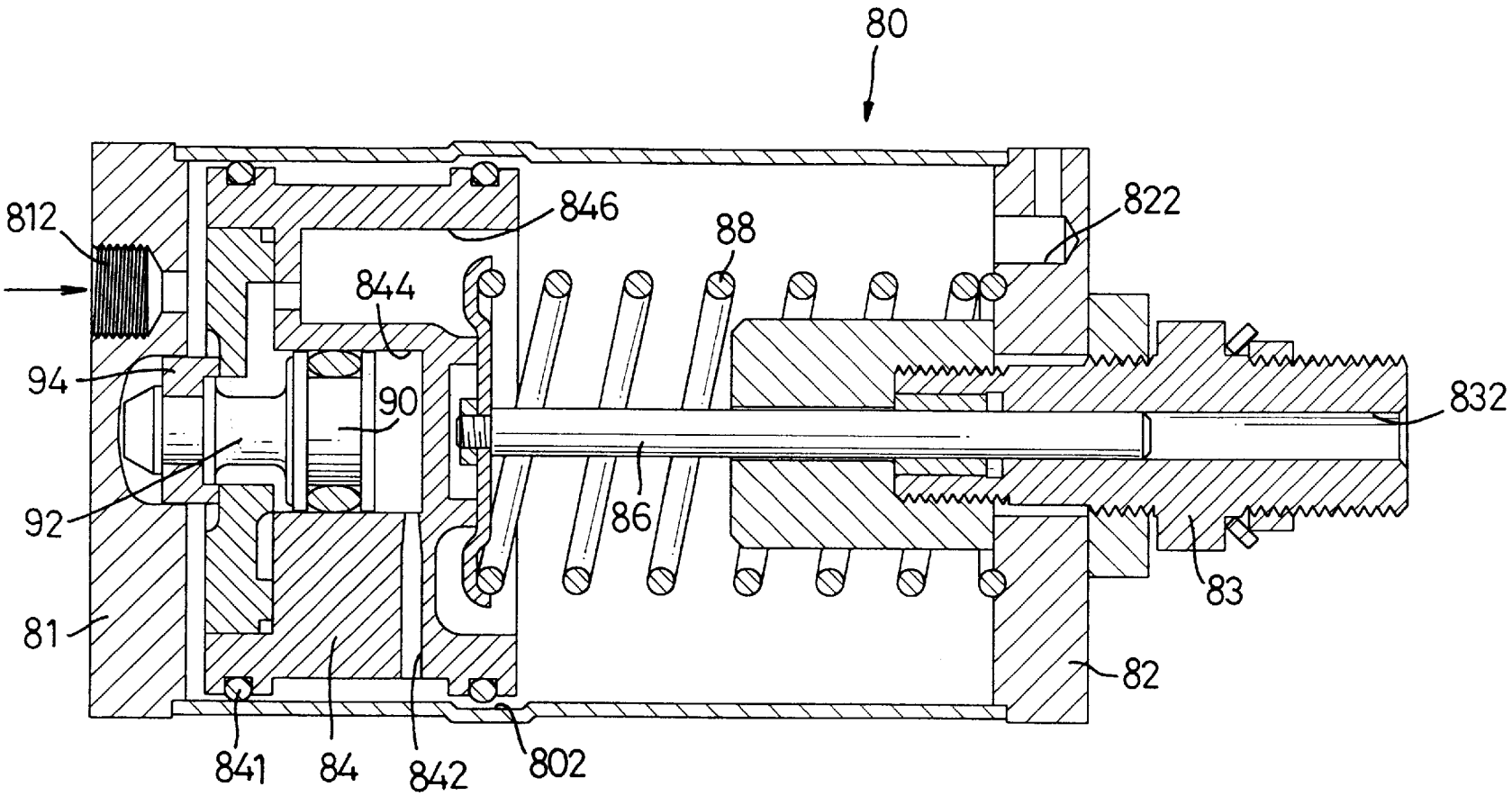
FIG. 8 PRIOR ART
FIG. 8 is a cross sectional side plan view of a conventional pneumatic motor for an oil pump in accordance with the prior art.
Figure 9:
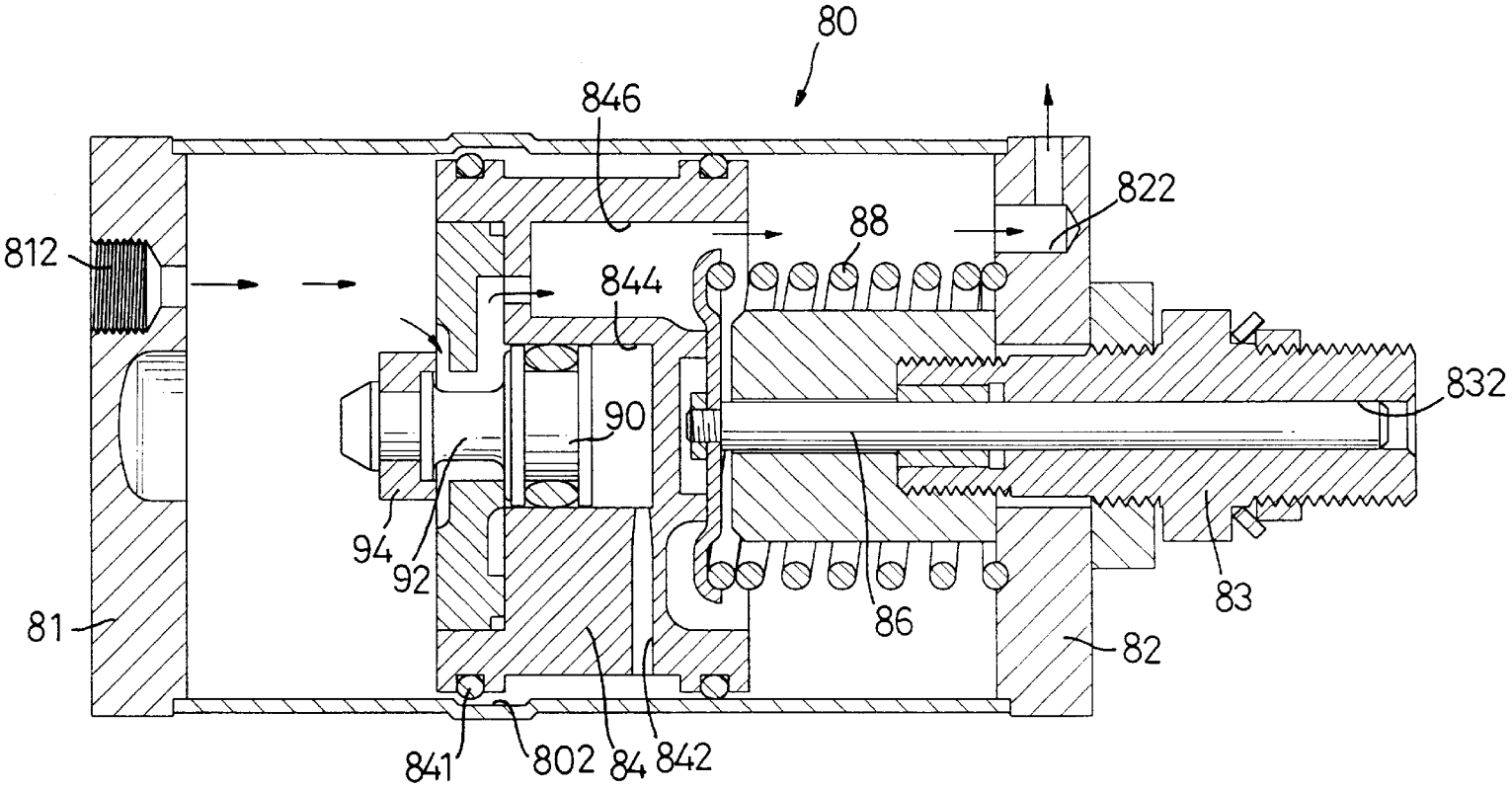
FIG. 9 PRIOR ART
FIG. 9 is an operational cross sectional side plan view of the conventional pneumatic motor for an oil pump in FIG. 8.

With reference to FIG. 7, a bolt (51) extends through the piston seat (50) and screws with the piston (40), such that the piston seat (50) is secured to the piston (40) with the bolt (51). The combination between the piston (40) and the piston seat (50) is improved.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A pneumatic oil pump comprising:

a cylinder having a central bore defined longitudinally through the cylinder, and a sealed front end and a sealed rear end;

a recess defined in an inner surface of the central bore of the cylinder near a middle of the cylinder;

an air connector mounted in the front end of the cylinder;

an actuating valve mounted in the front end of the cylinder and communicating with the air connector and the central bore of the cylinder;

a first piston movably mounted in the central bore to divide the central bore into a first chamber to be selectively communicating with air by means of the actuating valve and a second chamber and having:

two seals respectively mounted around the first piston at each end of the first piston;

an inlet passage defined in the first piston between the seals;

a cavity defined in the first piston to communicate with the inlet passage;

a first outlet passage defined in the first piston to communicate with both the first and the second chambers of the cylinder;

an inner piston movably received in the cavity in the first piston;

a rod secured to the inner piston and extending into the first chamber of the cylinder; and a valve disk secured to the rod to close a passage between the outlet passage and first chamber of the cylinder;

a piston seat securely attached to the first piston on a side facing the rear end of the cylinder;

a second outlet passage defined in the piston seat and aligning with the first outlet passage in the first piston;

a ventilative, sound-absorbing member mounted between the air outlets of the first piston and the piston seat;

a drive rod secured to the piston seat;

a piston spring mounted around the drive rod and located between the sealed end of the cylinder and the piston seat to provide a restoration force to the piston seat and the first piston;

an exhaust valve mounted on the cylinder to selectively allow the communication of the second chamber with the air for controlling the exhaust of air;

a pedal pivotally mounted on the cylinder and having one end aligning with the actuating valve;

an oil reservoir mounted on the rear end of the cylinder;

an oil channel defined in the rear end of the cylinder to communicate with the oil reservoir;

a first ball and spring combination movably received in the oil channel to close the communication between the oil channel and the oil reservoir;

a rod base attached to the rear end of the cylinder and facing the front end of the cylinder and having a passage aligning and communicating with the oil channel defined in the rod base for the drive rod to extend into the passage of the rod base;

an oil discharge passage defined in the cylinder and communicating with the oil channel;

an oil discharge connector mounted on the cylinder and communicating with the oil discharge passage to be adapted to connect to a hydraulic device.

2. The pneumatic oil pump as claimed in claim 1, wherein the front end of the cylinder is covered with a front cover; and the air connector and actuating valve are mounted in the front cover.

3. The pneumatic oil pump as claimed in claim 2 further comprising a first stem movably extending out from the actuating valve and aligning with one end of the pedal.

4. The pneumatic oil pump as claimed in claim 2 further comprising a first pushing rod slidably mounted in the front cover; and wherein the first pushing rod aligns with the valve disk and communicates with the air connector.

5. The pneumatic oil pump as claimed in claim 1, wherein the rear end of the cylinder is covered with a rear cover;

the oil channel and oil discharge passage are defined in the rear cover; and the rod base and the oil discharge connector are mounted on the rear cover.

6. The pneumatic oil pump as claimed in claim 5, wherein a return passage is defined in the rear cover of the cylinder and communicates with the oil reservoir and the oil discharge passage; and a return valve is mounted in the rear cover and extends into the return passage to control the oil flow through the overflow passage.

7. The pneumatic oil pump as claimed in claim 6, wherein the return valve includes:

a second stem movably extending outward from the return valve and abutting the pedal;

a stem spring arranged to support the second stem;

a third ball and spring combination movably received in the return passage and aligning with the second stem in the return valve to normally close communication between the oil discharge passage and the return passage.

8. The pneumatic oil pump as claimed in claim 5, wherein an overflow passage is defined in the rear cover and communicates with the oil channel and the oil reservoir;

an adjusting valve mounted into the overflow passage to control the oil flow through the overflow passage.

9. The pneumatic oil pump as claimed in claim 8, wherein the adjusting valve includes:

a fourth ball and spring combination movably received in the overflow passage to normally close communication between the oil channel and the overflow passage;

a second pushing rod abutting the fourth ball; and a bolt abutting the third spring.

10. The pneumatic oil pump as claimed in claim 1, wherein a second piston made of resilient material is arranged in the exhaust valve to normally close communication between the cylinder and the exhaust valve.

11. The pneumatic oil pump as claimed in claim 1, wherein a combination vacuum breaker and air pressure relief valve is mounted on the oil reservoir to selectively allow air to flow in and out of the oil reservoir.

12. The pneumatic oil pump as claimed in claim 1, wherein multiple gaskets are mounted in the rod base and are snugly around the drive rod.

13. The pneumatic oil pump as claimed in claim 1, wherein a second ball and spring combination is movably received in the oil discharge passage to normally close communication between the oil channel and the oil discharge passage.

14. The pneumatic oil pump as claimed in claim 1, wherein a bolt extends through the piston seat and screws into the first piston to secure the piston seat to the first piston.

* * * * *